US007919446B1

(12) United States Patent
Fresco et al.

(10) Patent No.: US 7,919,446 B1
(45) Date of Patent: Apr. 5, 2011

(54) POST-CMP CLEANING COMPOSITIONS AND METHODS OF USING SAME

(75) Inventors: Zachary M. Fresco, Santa Clara, CA (US); Anh Duong, Union City, CA (US); Chi-I Lang, Sunnyvale, CA (US); Nikhil Kalyankar, San Jose, CA (US); Nicole Rutherford, Saratoga, CA (US); Alexander Gorer, Los Gatos, CA (US)

(73) Assignee: Intermolecular, Inc., San Jose, CA (US)

( * ) Notice: Subject to any disclaimer, the term of this patent is extended or adjusted under 35 U.S.C. 154(b) by 185 days.

(21) Appl. No.: 12/344,410

(22) Filed: Dec. 26, 2008

Related U.S. Application Data

(60) Provisional application No. 61/017,485, filed on Dec. 28, 2007, provisional application No. 61/017,486, filed on Dec. 28, 2007.

(51) Int. Cl.

| | |
|---|---|
| ***C11D 3/30*** | (2006.01) |
| ***C11D 1/42*** | (2006.01) |
| ***C11D 1/62*** | (2006.01) |

(52) U.S. Cl. ..... 510/175; 510/176; 510/432; 510/504; 134/1.3; 134/22.13; 134/22.14

(58) Field of Classification Search ..... 510/175, 510/176, 432, 504; 134/1.3, 22.13, 22.14
See application file for complete search history.

(56) References Cited

U.S. PATENT DOCUMENTS

| | | | | |
|---|---|---|---|---|
| 2003/0083214 | A1 * | 5/2003 | Kakizawa et al. | 510/175 |
| 2008/0004197 | A1 * | 1/2008 | Kneer | 510/245 |
| 2009/0239777 | A1 * | 9/2009 | Angst et al. | 510/175 |

* cited by examiner

*Primary Examiner* — Charles I Boyer

(57) ABSTRACT

Compositions comprise a purine compound; an alcohol amine; a quaternary ammonium salt; an amino acid, and optionally an antioxidant. The compositions are useful in post-CMP cleaning processes. One particular advantage of these compositions is that they can effectively remove slurry contamination without increasing the roughness of the copper surface.

7 Claims, 5 Drawing Sheets

POST-CMP CLEANING COMPOSITIONS AND METHODS OF USING SAME

RELATED APPLICATIONS

This application claims the benefit of and priority to U.S. Provisional Patent Application Ser. Nos. 61/017,485 and 61/017,486, both filed Dec. 28, 2007, and titled POST-CMP CLEANING COMPOSITIONS AND METHODS OF USING SAME, the entire disclosures of which are herein incorporated by reference.

BACKGROUND

Chemical mechanical polishing (CMP) is a technique designed to remove material from semiconductor substrates. One approach is to use a chemical composition in conjunction with mechanical abrasion, a process that may involve application of the chemical onto the semiconductor, onto a polishing pad, or both. The function of the chemical and pad is to remove material from the substrate; a secondary function is to reduce surface roughness of the substrate. Often another chemical is used after the CMP process, a so-called post-CMP cleaning composition, to remove residual particles such as abrasive particles and substrate particles left on the semiconductor substrate after CMP. In use, some of the post-CMP chemicals have been found to actually increase surface roughness.

Although there are a number of post-CMP cleaning compositions and methods known in the art, there is a continuing desire for post-CMP cleaning compositions having desirable features.

BRIEF DESCRIPTION OF THE DRAWINGS

For a more complete understanding of the features and advantages of the present invention, reference is now made to the detailed description of the invention along with the accompanying figures and in which.

DETAILED DESCRIPTION

Figure 1:
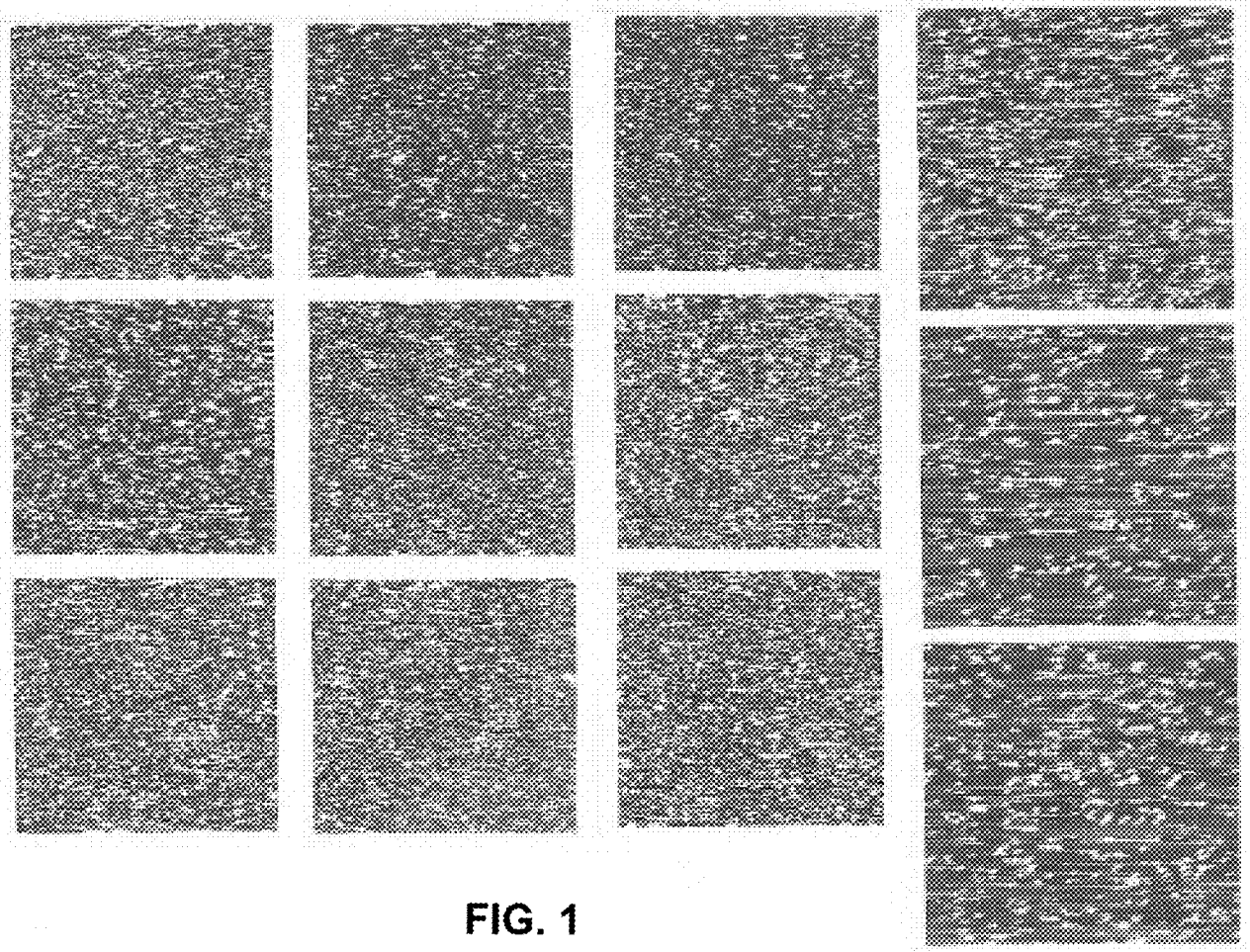
FIGS. 1 and 3 are atomic force microscope (AFM) images of the copper surface from first and second copper test coupons, respectively, post-CMP but previous to exposure to post-CMP cleaning chemicals.

Compositions for post-CMP cleaning are described herein. The compositions may be applied to a substrate or wafer on which CMP was performed. The substrate or wafer may have residual slurry particles that may affect subsequent processing and/or device formation. The compositions described herein are useful for removing any type of CMP slurry, including but not limited to silica, alumina, and ceria slurries.

In one aspect, the present disclosure describes a post-CMP cleaning composition comprising:

a) optionally an amino acid, selected from glycine and other amino acids, such as alanine, aspartic acid, glutamic acid, lysine, arginine, phenylalanine, methionine, leucine, valine, isoleucine, threonine, tryptophan, and mixtures of two or more amino acids;

b) a purine compound;

c) an alcohol amine;

d) a quaternary ammonium salt; and e) optionally an antioxidant.

In some embodiments the balance of the composition is water. In some embodiments the amino acid is glycine. The post-CMP cleaning solution may also be formulated without the amino acid and still be effective at removing particles. In some embodiments the purine compound is selected from uric acid, adenine, guanine, guanosine, purine, caffeine, xanthine, hypoxanthine, theobromine, tautomers thereof, and mixtures of two or more thereof. In some embodiments the alcohol amine is selected from monoethanolamine, triethanolamine, triisopropanolamine, 1-amino-2-propanol, and mixtures of two or more thereof. In some embodiments the quaternary ammonium salt is a compound comprising at least one hydroxyl group, and is selected from tetraalkylammonium hydroxides containing alkyl groups having from 1 to 4 carbon atoms and mixtures of two or more thereof. In some embodiments the composition has a pH of at least 9. In some embodiments the composition comprises an antioxidant. In some embodiments the antioxidant is selected from ascorbic acid, quercitin, phenanthroline, nicotinamide, pyruvic acid, glycolic acid, and succinic acid, salts of any of these, derivatives of any of these, and mixtures of two or more of these. In some embodiments the amino acid is present at a concentration ranging from about 0.5 to about 3 (in certain embodiments from 0.5 to 1.75, or from 0.5 to 1.5, or from 0.5 to 1.25, or from 0.5 to 1, or from 0.5 to 0.75, or 0.5) weight percent. In some embodiments the purine compound is present at a concentration ranging from about 0.1 to about 0.6 (or from 0.1 to 0.5, or 0.1 to 0.4, or 0.1 to 0.3, or 0.1 to 0.2, or 0.3) weight percent based on total weight of the composition. (All weight percentages are based on total weight of composition unless otherwise specified.). In some embodiments the alcohol amine is present at a concentration ranging from about 1 to about 5 (in certain embodiments from 1 to 4, or 1 to 3, or 1.5 to 2.5, or from 1.75 to 2) weight percent. In some embodiments the quaternary ammonium salt is present at a concentration ranging from about 3 to about 7 (in certain embodiments from 3.5 to 6.5, or from 4 to 6, or from 4.5 to 5.5, or 5) weight percent. In some embodiments the antioxidant is present at a concentration ranging from about 0.7 to about 3.5 (in certain embodiments from 0.8 to 3.5, or 1 to 3.5, or 1.5 to 3.5, or 2 to 3.5, or 2.5 to 3.5, or 3 to 3.5, or 3.5) weight percent.

In another aspect, the present disclosure describes a post-CMP cleaning composition comprising:

a) from about 3 to about 7 weight percent TMAH;

b) from about 0.5 to about 3 weight percent of at least one amino acid;

c) from about 0.1 to about 0.6 weight percent uric acid;

d) from about 1 to about 5 weight percent of at least one alcohol amine;

e) optionally from about 0.7 to about 3.5 weight percent of an antioxidant;

f) balance water.

In some embodiments the at least one amino acid comprises glycine, and the at least one alcohol amine comprises monoethanolamine. In some embodiments the at least one amino acid is selected from the group consisting of glycine, alanine, aspartic acid, glutamic acid, lysine, and arginine; and wherein the at least one alcohol amine is selected from the group consisting of monoethanolamine, 1-amino-2-propanol, triethanolamine, and triisopropanolamine.

In another aspect, the present disclosure describes a post-CMP cleaning composition comprising:

a) from about 3 to about 7 weight percent TMAH;

b) from about 0.5 to about 3 weight percent of glycine;

c) from about 0.1 to about 0.6 weight percent of at least one purine compound;

d) from about 1 to about 5 weight percent of at least one alcohol amine;

e) optionally from about 0.7 to about 3.5 weight percent of an antioxidant;

f) balance water.

In certain embodiments the at least one purine compound comprises uric acid, and the at least one alcohol amine comprises monoethanolamine. In certain embodiments the at least one purine compound is selected from the group consisting of uric acid, guanosine, adenine, guanine, and purine; and the at least one alcohol amine is selected from the group consisting of monoethanolamine, 1-amino-2-propanol, triethanolamine, and triisopropanolamine.

In another aspect, the present disclosure describes a process of cleaning a substrate after CMP of the substrate, comprising the steps of:

a) preparing a composition comprising optionally an amino acid, a purine compound, an alcoholic amine, a quaternary ammonium salt, optionally an antioxidant, and water; and b) optionally diluting the composition between about 10 and about 100 fold with deionized water to form a diluted composition c) contacting the composition with the substrate for a time and at a temperature ranging from about −5° C. to about 90° C. sufficient to remove substantially all CMP compounds remaining on the substrate after CMP; and d) optionally rinsing the substrate with deionized water.

In some embodiments the process comprises mixing (all or a portion of) the amino acid and the purine compound into a first composition comprising the alcohol amine, the quaternary ammonium salt, and the antioxidant. In some embodiments the time is less than about 60 seconds (in certain embodiments less than 55, or 50, or 45, or 40, or 35, or 30, or 25, or even 20 seconds). In some embodiments the contacting is selected from spin-spray cleaning, soaking, brushing, sonic cleaning, stirred tank cleaning, and combinations thereof. In some embodiments the composition may first be prepared in concentrated form, and then diluted with deionized water before use. The process may be performed on a single wafer or with batch processing. In some embodiments the process comprises the temperature ranging from about 0° C. to about 85° C., (in certain embodiments about 5° C. to about 80° C., or about 10° C. to about 75° C., or about 15° C. to about 70° C., or about 20° C. to about 65° C., or about 20° C. to about 60° C., or about 20° C. to about 55° C., about 20° C. to about 50° C., or about 20° C. to about 25° C.).

In certain processes, the composition is prepared in concentrated form, then diluted with deionized water for use. In certain embodiments, dilution can be at least 10 fold (or 20, 30, 40, 50 or 60 fold).

In certain embodiments, one component of the composition may be used to fulfill one or more functions. In other embodiments, two or more components may contribute to one or more functions. For example, both alcoholic amines and quaternary ammonium salt may contribute to pH being at least 9. In certain processes, the cleaning may be followed by one or more rinse steps employing, for example, deionized water.

In compositions of the invention the purine compound functions to clean and smooth the substrate. As used herein the term "purine compound" includes substituted purines and their tautomers. While not being bound by any particular theory, it appears the purine compound may be reacting with the substrate surface (possibly in conjunction with the amino acid ingredient and quaternary ammonium salt), and/or displacing chemicals used in chemical mechanical polishing, such as benzotriazole, and possibly metal substrate surface atoms or oxides of metal substrate surface atoms, and other debris. The substrate may include a conductive material such as copper, ruthenium, gold, platinum, lead, tin, tungsten, aluminum or alloy thereof. When the substrate is a copper substrate, or a copper-coated substrate, or alloy of copper and another metal, copper atoms and/or copper oxides may be displaced by the purine compound.

Purines are heterocyclic aromatic organic compounds having a pyrimidine ring (6-membered ring in structure I) fused to an imidazole ring (5-membered ring in structure I). Purines have a nucleus or portion of the nucleus of the general formula (I):

(I)

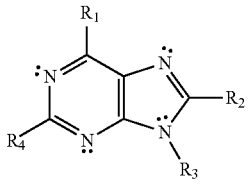

wherein $R_1$, $R_2$, $R_3$ and $R_4$ are independently H, an alkyl group containing 1 to about 12 carbon atoms, oxo, —$NH_2$, aryl, arylalkyl, or together form a cyclic or heterocyclic moiety.

Examples of suitable purines for use in compositions described herein include purine, adenine, guanine, hypoxanthine, xanthine, theobromine, caffeine, uric acid, and isoguanine. The structures of these compounds are well known.

An example of a substituted purine suitable for use in compositions described herein is guanosine (structure II) which is a nucleoside comprising guanine attached to a ribose (ribofuranose) ring via a β-$N_9$-glycosidic bond. Guanosine can be phosphorylated to become GMP (guanosine monophosphate), cGMP (cyclic guanosine monophosphate) and GTP (guanosine triphosphate).

II

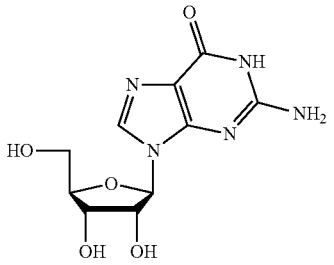

Alcohol amines function in compositions described herein to partially or completely solubilize metal oxides. In the case of copper substrates being cleaned, both CuO and $Cu_2O$ oxides may be solubilized. Ethanolamine, also called 2-aminoethanol or monoethanolamine (often abbreviated as MEA), is an organic chemical compound which is both a primary amine (due to an amino group in its molecule) and a primary alcohol (due to a hydroxide group). Other suitable alcohol amines include 1-amino-2-propanol, triisopropanolamine, monopropanoldiethanolamine, monoethanol-diisopropanolamine, tri-n-butanolamine, triisobutanolamine, and the like. It is contemplated that aromatic alcohol amines may also be used. Mixtures of these may be used.

In certain embodiments the alcohol amine is present at a concentration ranging from about 1 to about 3 (in certain embodiments from 1.25 to 2.75, or from 1.5 to 2.5, or from 1.75 to 2.25, or 2) weight percent. In some embodiments the alcohol amine is present at a concentration ranging from about 1 to about 2 (in certain embodiments from 1.25 to 2, or 1.5 to 2, or 1.75 to 2, or 2) weight percent. In some embodiments the alcohol amine is present at a concentration ranging from about 1 to about 5 (in certain embodiments from 1 to 4, or 1 to 3, or 1.5 to 2.5, or 2) weight percent. The concentration to use depends on the metal oxide solubilizing efficiency of the particular compound or mixture of compounds used, and the other ingredients used.

Quaternary ammonium salts are cationic organic compounds that are surface active coordination compounds that tend to adsorb onto surfaces. Therefore in theory they function to displace metals and/or metal oxides. They are also disinfectants and cleansers, and may mildly etch some materials. In concentrated embodiments of compositions described herein the pH may be 12 or 13, while pH from 8 to 11 is typical for diluted compositions. Quaternary ammonium salts are also known as quats. They are positively charged polyatomic ions of the structure $NR_4^+$ with R being the same or different alkyl or other organic groups. Unlike the ammonium ion $NH_4^+$ itself and primary, secondary, or tertiary ammonium cations, the quaternary ammonium cations are permanently charged, independent of the pH of their solution. Quaternary ammonium cations are synthesized by complete alkylation of ammonia or other amines. Examples of useful quaternary ammonium salts are salts of quaternary ammonium cations with an anion; in many embodiments the anion is hydroxyl, OH—, but this is not necessary to the disclosed compositions. Tetramethylammonium hydroxide (TMAH), tetraethylammonium hydroxide (TEAH), tetrapropylammonium hydroxide (TPAH), tetra-n-butylammonium hydroxide (TnBAH), and tetra-1-butylammonium hydroxide (TiBAH) are quaternary ammonium salts useful in compositions of this disclosure. It is also contemplated that quaternary ammonium salts wherein the hydroxide group is replaced by another anion, such as F— or Cl—, may be useful. Other quaternary ammonium salts that may be useful include compounds such as acetalcholine bromide, octadecyldimethylbenzyl ammonium chloride, and the like.

In certain embodiments the quaternary ammonium salt is present at a concentration ranging from about 3 to about 7 (or from 3.5 to 6.5, or from 4 to 6, or from 4.5 to 5.5, or 5) weight percent.

Amino acids are organic compounds having an amine group, a carboxylic acid group, a hydrogen, and a side chain group. (In glycine the side chain is hydrogen.) At neutral pH, amino acids are zwitterions, due to having the basic amine functional group as well as the carboxylic acid group in the same molecule. Amino acids are deprotonated in compositions having pH of 9 or greater, and it is theorized that this leads to the deprotonated amino acids having greater affinity for the surface being cleaned than other chemicals, such as cleaners used in chemical mechanical polishing. It is theorized there is also some unexpected synergy between the purine compounds and the amino acids at pH at or above 9 which leads to decreased RMS roughness values, as well as better cleaning efficiency. The amine may be primary, secondary, or tertiary. Examples of suitable amino acids for use in the disclosed compositions include glycine, alanine, aspartic acid, glutamic acid, lysine, arginine, phenylalanine, methionine, leucine, valine, isoleucine, threonine, tryptophan, and mixtures of two or more amino acids.

In some embodiments the composition comprises an antioxidant. In some embodiments the antioxidant is selected from ascorbic acid, quercitin, phenanthroline, nicotinamide, pyruvic acid, glycolic acid, and succinic acid, salts of any of these, derivatives of any of these, and mixtures of two or more of these. In some embodiments the antioxidant is present at a concentration ranging from about 0.7 to about 3.5 (in certain embodiments from 0.8 to 3.5, or 1 to 3.5, or 1.5 to 3.5, or 2 to 3.5, or 2.5 to 3.5, or 3 to 3.5, or 3.5) weight percent.

EXAMPLES

Five post-CMP cleaning compositions were tested on coupons contaminated with silica CMP slurry particles. The compositions tested are listed in Table 1 (all numbers are weight percent). Compositions A and B are commercially available, and therefore served as comparative test compositions. Compositions I, II and III were compositions described in this disclosure. Comparative compositions A and B and disclosed compositions I, II, and III were evaluated with regard to their cleaning efficiency and the effect on copper roughness.

TABLE 1

| | Compositions Tested | | | | |
|---|---|---|---|---|---|
| Chemical | A | B | I | II | III |
| TMAH | 5 | 5 | 5 | 5 | 5 |
| MEA | 9 | 1 | 2 | 2 | 2 |
| ascorbic acid | 3.5 | 0.7 | 0 | 1.75 | 3.5 |
| Glycine | 0 | 0 | 1 | 2.5 | 0.5 |
| uric acid | 0 | 0 | 0.3 | 0.3 | 0.1 |
| Water | balance | balance | balance | balance | balance |

Figure 2:
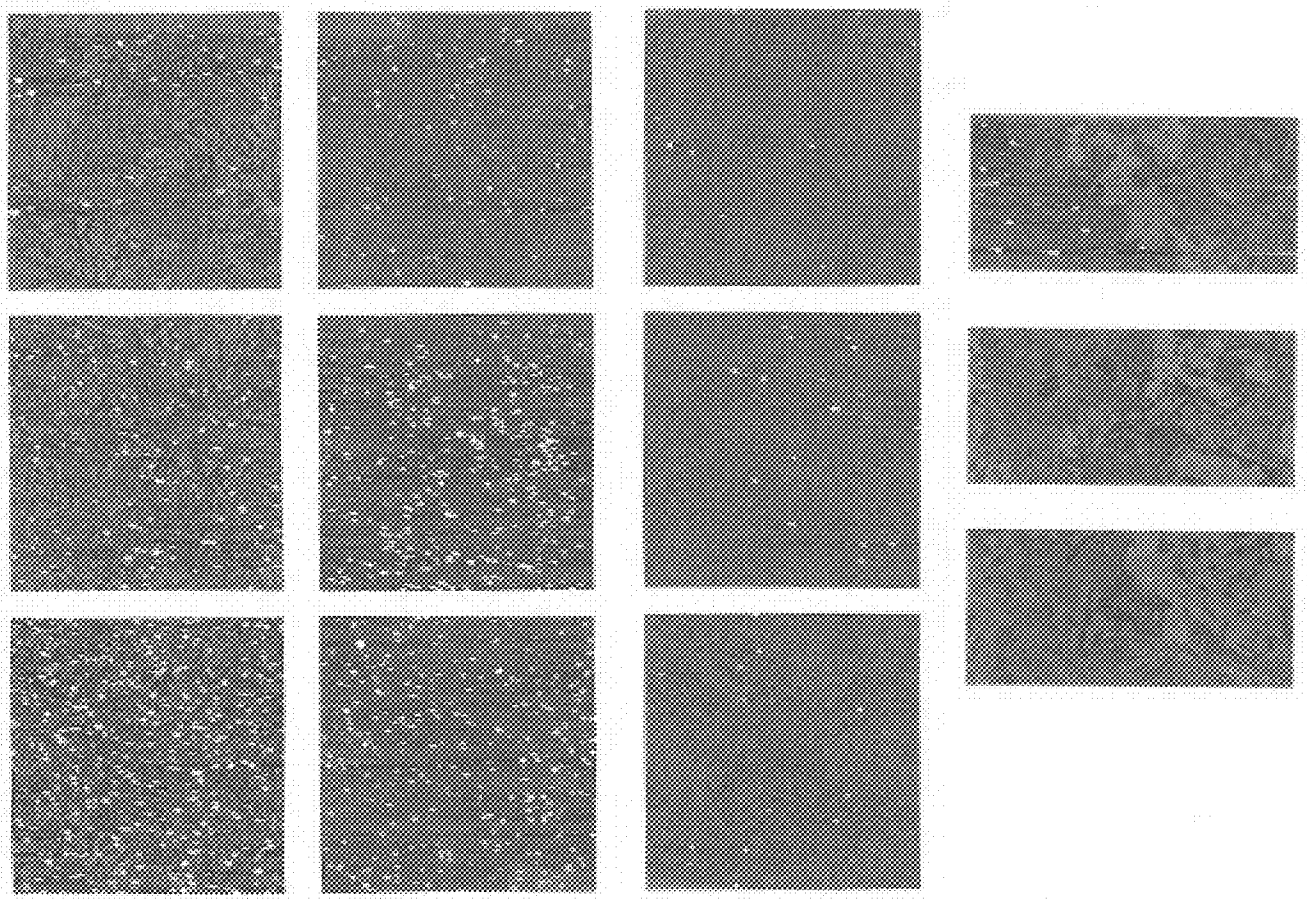
FIGS. 2 and 4 are atomic force microscope (AFM) images of the copper surface from first and second copper test coupons of FIGS. 1 and 3, respectively, after treatment by post-CMP cleaning chemicals.
Figure 3:
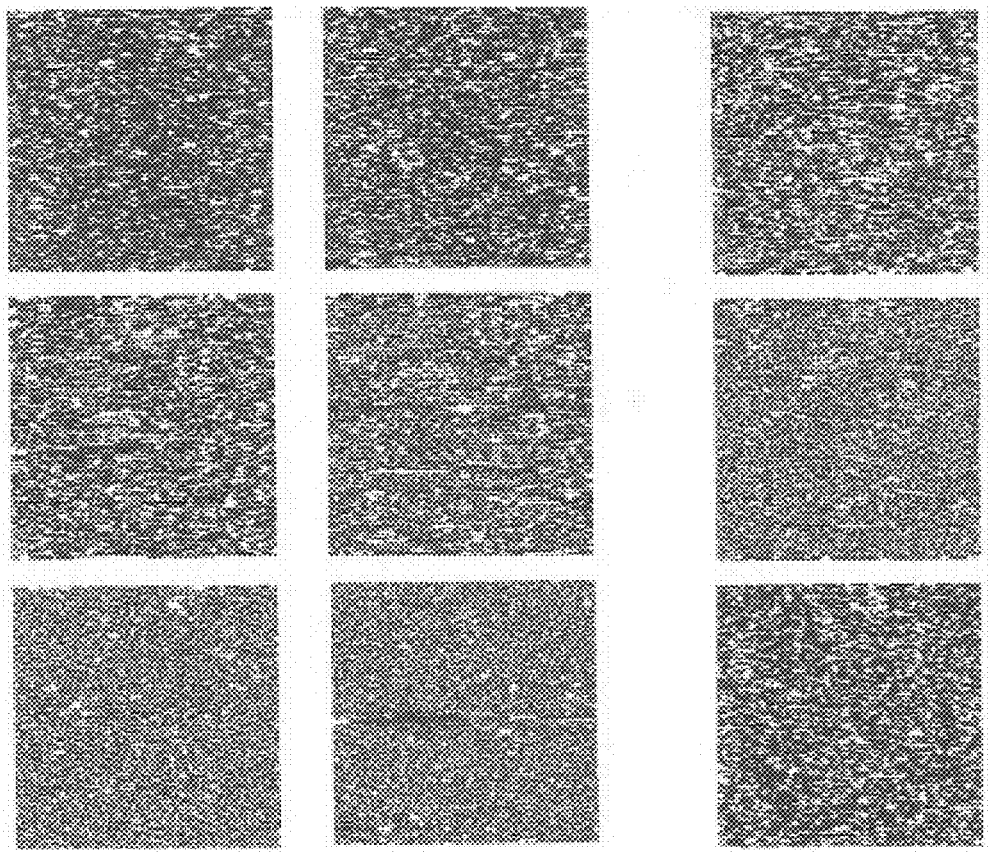
Figure 4:
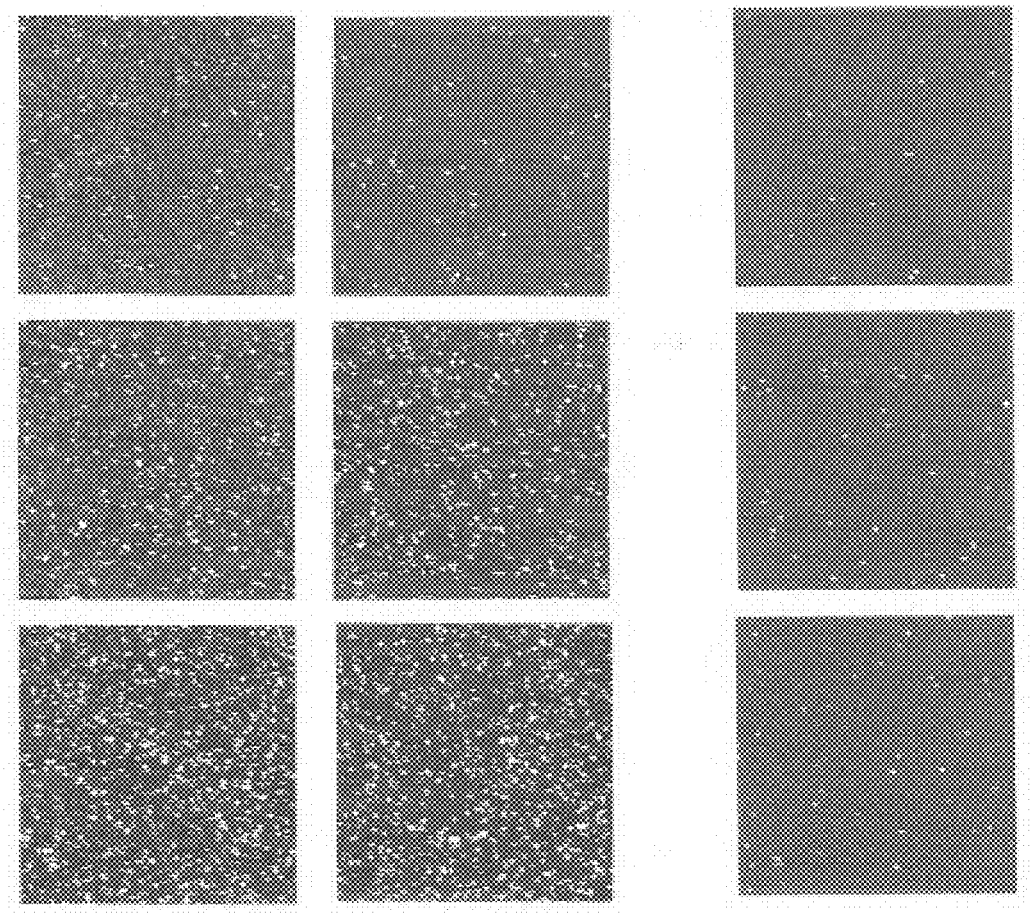

Columns 1, 2 and 3 of FIGS. 1 and 3 are Atomic Force Microscope (AFM) images (images are 20 μm×20 μm, z scale is 30 nm) of the copper surface from the first and second copper test coupons (coupons 1 and 2), respectively, post-CMP but previous to exposure to compositions A, B and I of Table 1. Column 4 of FIG. 1 shows AFM images of the copper surface from a third copper test coupon (coupon 3) post-CMP but previous to exposure to composition II of Table 1. Composition II was tested separately from compositions A, B and I described above. Composition II was reacted for 300 seconds at 25 degrees centigrade with stirring at 3000 rpm. The CMP process was performed using an LK393-C3 silica slurry available from Rohm and Haas. FIGS. 2 and 4 are AFM images of the copper surface of FIGS. 1 and 3, respectively, after treatment by post-CMP cleaning chemicals. In FIGS. 1 and 3, the images have been arranged so that column 1 shows the 3 images prior to post-CMP cleaning to be cleaned using comparative composition A; and column 2 shows the 3 images prior to post-CMP cleaning to be cleaned using comparative composition B. Columns 3 and 4 show images prior to post-CMP cleaning to be cleaned using compositions I and II described herein, respectively. FIGS. 2 and 4 show the same surfaces as FIGS. 1 and 3, after cleaning using the various post-CMP cleaning compositions. Compositions A, B and I, a 300 second reaction time, with a 30 second rinse time was used, with stirring at 3,000 rpm, and all were stirred at 3000 rpm for 5 min, while Composition II was stirred at 3000 rpm for 5 min. All cleaning was performed at 25° C. liquid temperature. The CMP process was performed using an LK393-C3 silica slurry available from Rohm and Haas. Cleaning efficiency can be evaluated by examining the number of silica particles remaining on the copper surface. Silica particles can be identified as white spots (i.e., "high" spots or large particles) in the AFM images of FIGS. 1-4. As can be seen by comparing columns 3 and 4 to columns 1 and 3 in FIGS. 2 and 4, compositions I and II seemed to perform equivalently in terms of cleaning efficiency, judged using visual inspection. Additionally, compositions I and II removed more silica particles than compositions A and B. Therefore, as may be seen from FIGS. 2 and 4, Compositions I and II removed silica slurry better than Comparative compositions A and B.

Table 2 lists the raw RMS roughness values for the post-cleaned copper surfaces shown in FIG. 2, and Table 3 lists the average RMS roughness values for each composition. Similarly, Table 4 lists the raw RMS roughness values for the post-cleaned copper surfaces shown in FIG. 4, and Table 5 lists the average RMS roughness values for each composition after the application of the post-CMP cleaning formulations.

TABLE 2

Raw RMS Roughness values, coupons 1 and 3

| Image number (location) | Composition | RMS roughness |
|---|---|---|
| 1 (Column 1, line 1) | A | 4.995 |
| 2 (Column 2, line 1) | B | 1.138 |
| 3 (Column 3, line 1) | I | 0.911 |
| 4 (Column 4, line 1) | II | 3.70 |
| 5 (Column 1, line 2) | A | 5.413 |
| 6 (Column 2, line 2) | B | 1.588 |
| 7 (Column 3, line 2) | I | 1.252 |
| 8 (Column 4, line 2) | II | 1.79 |
| 9 (Column 1, line 3) | A | 5.317 |
| 10 (Column 2, line 3) | B | 1.573 |
| 11 (Column 3, line 3) | I | 1.320 |
| 12 (Column 4, line 3) | II | 1.52 |

TABLE 3

Average RMS roughness values, coupons 1 and 3

| Composition | Average RMS roughness (nm) |
|---|---|
| A | 5.242 |
| B | 1.433 |
| I | 1.161 |
| II | 2.34 |

TABLE 4

Raw RMS Roughness values, coupon 2

| Image number (location) | Composition | RMS roughness |
|---|---|---|
| 1 (Column 1, line 1) | A | 4.210 |
| 2 (Column 2, line 1) | B | 0.936 |
| 3 (Column 3, line 1) | I | 0.974 |
| 4 (Column 4, line 1) | II | — |
| 5 (Column 1, line 2) | A | 4.339 |
| 6 (Column 2, line 2) | B | 1.973 |
| 7 (Column 3, line 2) | I | 1.066 |
| 8 (Column 4, line 2) | II | — |
| 9 (Column 1, line 3) | A | 5.348 |
| 10 (Column 2, line 3) | B | 3.580 |
| 11 (Column 3, line 3) | I | 0.949 |
| 12 (Column 4, line 3) | II | — |

TABLE 5

Average RMS roughness values, coupon 2

| Composition | Average RMS roughness (nm) |
|---|---|
| A | 4.632 |
| B | 2.613 |
| I | 0.996 |

As may be seen from Tables 3 and 5, composition I affected RMS roughness less than comparative compositions A and B. Composition II affected RMS roughness about the same as comparative composition B, but was much better than comparative composition A. Cleaning efficiency can be evaluated by examining the number of silica particles remaining on the copper surface. Silica particles can be identified as white spots (i.e. "high" spots or large particles) in the AFM images of FIGS. 1-5. As can be seen by comparing columns 3 to 4 to columns 1 and 3 in FIGS. 2 and 4, compositions I and II seemed to perform equivalently in terms of cleaning efficiency, judged using visual inspection. Additionally, compositions I and II removed more silica particles.

Figure 5:
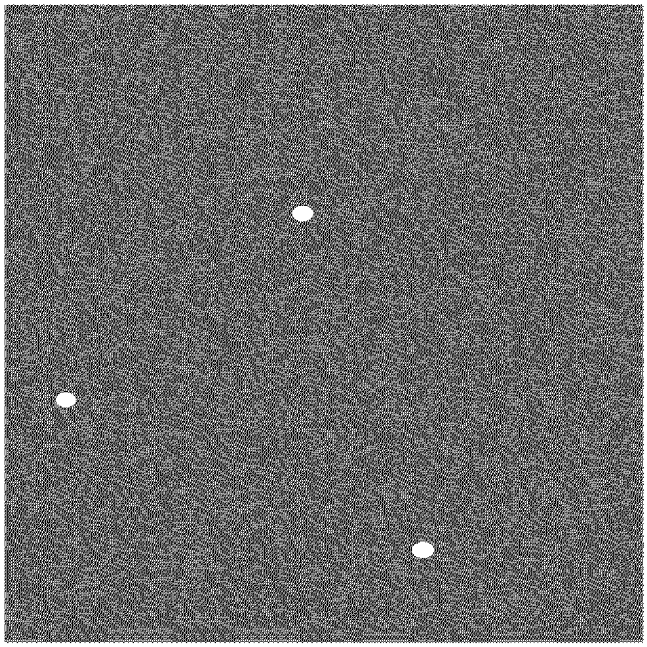
FIG. 5 is an AFM image of a third copper coupon after cleaning using a composition described herein.

FIG. 5 is an AFM image of the cleaning efficiency of composition III as described in Table 1. FIG. 5 shows a copper surface that was contaminated with CMP slurry, and which cleaned using composition III. As can be seen in FIG. 5, very few silica particles remain on the copper surface. The RMS roughness of the copper surface shown in FIG. 5 is 1.02.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. A post-CMP cleaning composition comprising:

a) about 3 to about 7 weight percent tetramethylammonium hydroxide;

b) about 0.5 to about 3 weight percent tryptophan;

c) about 0.1 to about 0.6 weight percent guanosine;

d) about 1 to about 5 weight percent of monoethanolamine; and e) balance water.

2. The composition of claim 1, further comprising an antioxidant comprising ascorbic acid.

3. A process of cleaning a substrate after CMP of the substrate, comprising the steps of:

a) preparing a composition comprising an amino acid, theobromine, an alcoholic amine, a quaternary ammonium salt, an antioxidant, and water; and b) contacting the composition with the substrate for a time and at a temperature ranging from about −5° C. to about 90° C. sufficient to remove substantially all CMP compounds remaining on the substrate after CMP.

4. The process of claim 3 wherein the preparing step comprises mixing all or a portion of the amino acid and theobromine into a first composition comprising the alcohol amine, the quaternary ammonium salt, and the antioxidant.

5. The process of claim 3 wherein the time is less than about 60 seconds.

6. The composition of claim 1 having a pH of at least 9.

7. The composition of claim 2 wherein the antioxidant is present at a concentration ranging from about 0.7 to about 3.5 weight percent, based on the total weight of the composition.

* * * * *